United States Patent [19]

Marxer

[11] Patent Number: 4,821,433

[45] Date of Patent: Apr. 18, 1989

[54] SKI BOOT

[75] Inventor: Herbert Marxer, Schaan, Liechtenstein

[73] Assignee: Lange International S.A., Fribourg, Switzerland

[21] Appl. No.: 18,054

[22] Filed: Feb. 24, 1987

[30] Foreign Application Priority Data

Apr. 18, 1986 [CH] Switzerland ..... 1577/86

[51] Int. Cl.[4] ..... A43B 5/04; A43C 11/00

[52] U.S. Cl. ..... 36/121; 36/50

[58] Field of Search ..... 36/50, 117–121, 36/68 SK; 24/69 SK, 70 SK, 71 SK

[56] References Cited

U.S. PATENT DOCUMENTS

| | | | |
|---|---|---|---|
| 4,349,971 | 9/1982 | Everest III | 36/121 |
| 4,519,150 | 5/1985 | Arieth et al. | 36/121 |
| 4,575,958 | 3/1986 | Arieth et al. | 36/121 |
| 4,677,771 | 7/1987 | Arieth et al. | 36/120 |

FOREIGN PATENT DOCUMENTS

| | | | |
|---|---|---|---|
| 0149445 | 7/1985 | European Pat. Off. | 36/121 |
| 57-86301 | 5/1982 | Japan | 36/121 |
| 639250 | 11/1983 | Switzerland | 36/121 |

*Primary Examiner*—James Kee Chi

*Attorney, Agent, or Firm*—Kane, Dalsimer, Sullivan, Kurucz, Levy, Eisele and Richard

[57] ABSTRACT

The boot is composed of a lower shell (1), on which an upper (2) is articulated about a pivot axis (5) coinciding at least approximately with the joint of the foot. The shell (1) has on the outside, at the rear, a rounded portion (12), the radius of curvature of which is centered on the pivot axis (5), to allow the upper (2) to tilt to the rear. Means, such as ribs (17), are provided inside the part (11) of the shell in order to limit the space intended for receiving the skier's heel.

4 Claims, 2 Drawing Sheets

SKI BOOT

FIELD OF THE INVENTION

The present invention relates to a ski boot made of at least semi-rigid material and consisting of a shell comprising the sole and surrounding the foot and the heel and of an upper which is hinged with the shell about a transverse pin and at least part of which is pivotable backwards on the shell, and comprising moreover, at the rear, a mechanism connecting the shell and the upper, consisting of a lever passing through the pivotable part of the upper and hinged, at its bottom end, with the shell and connected via a link to the said pivotable part of the upper, the lever and the link forming a knuckle joint which enables the upper to be locked relative to the shell, in a forwards inclined skiing position, or to be released so as to allow it to pivot on the shell into a rest or walking position.

The upper may consist of a single piece, as in the case of boots where the foot is inserted at the top, or of two pieces, as in the case of boots where the foot is inserted at the rear.

PRIOR ART

A boot of this type is known from the patent CH No. 639,250 of the Applicant. In order to change over from the position where the mechanism is open and released, into the position where it is closed and locked, the user must exert a strong pressure on the lever in order to press it against the boot. During this closing movement, the resistance of the boot itself must also be overcome in order to pass beyond the neutral position of the knuckle joint, i.e. the position where these three hinging points are aligned. It is also difficult for the skier to gain access to the lever in order to operate it.

SUMMARY OF THE INVENTION

The aim of the present invention is to facilitate closing of the connecting mechanism.

For this purpose, the boot according to the invention comprises an elastic body accommodated in a cavity formed between the upper and one of the ends of the connecting mechanism hinged with the upper, this recess being limited on the outside by an extended portion of the said end, which portion is oriented substantially parallel to the axis of the connecting mechanism and extends beyond the point where the latter is hinged with the boot, such that this elastic body is compressed when the connecting mechanism is opened.

The elastic body, which is for example a rubber ball arranged behind an extension of the link, therefore tends to oppose opening of the connecting mechanism and consequently to favour its closure and keep the mechanism in the closed position. When the skier wishes to change from the rest or walking position into the skiing position, he does not have to operate the lever in order to close the connecting mechanism, but merely to adjust the position of the upper. As soon as the upper is sufficiently inclined, the connecting mechanism automatically closes owing to the action of the elastic body arranged at the end of the link. Since inclination of the upper may be caused by flexure of the leg, the connecting mechanism can be closed automatically. The lever is consequently only used for opening, the end of the said lever being pulled, this pulling movement being much easier to perform than the pushing movement.

The elastic body can be arranged between the link and the upper as well as between the lever and the shell of the boot.

In addition, it is possible to provide, in the region where the link is hingeably connected to the lever, a spring, for example a torsional spring, which also opposes the opening movement of the mechanism.

Owing to the presence of the elastic body and, where applicable, the additional spring, it is not necessary for the pin hingeably connecting the link to the lever to go beyond the straight line joining the two other hinging points of the mechanism, when the mechanism is closed, since the elastic body and, where applicable, the additional springs are sufficient to prevent the mechanism from leaving its neutral position in which the three hinging points are aligned. Opening of the connecting mechanism is thereby made easier since it is no longer necessary to extend first of all the connecting mechanism and to overcome the resistance of the boot in order to achieve the position where the hinging points are aligned.

If the pin hingeably connecting the link to the upper or the pin hingeably connecting the lever to the shell is mounted with longitudinal play, it is also possible to achieve an elastic connection by inserting an elastic member between the said pin and a stop integral with the upper or the shell.

BRIEF DESCRIPTION OF THE DRAWINGS

The accompanying drawing shows, by way of an example, an embodiment of the invention.

DESCRIPTION OF THE PREFERRED EMBODIMENT

Figure 2:
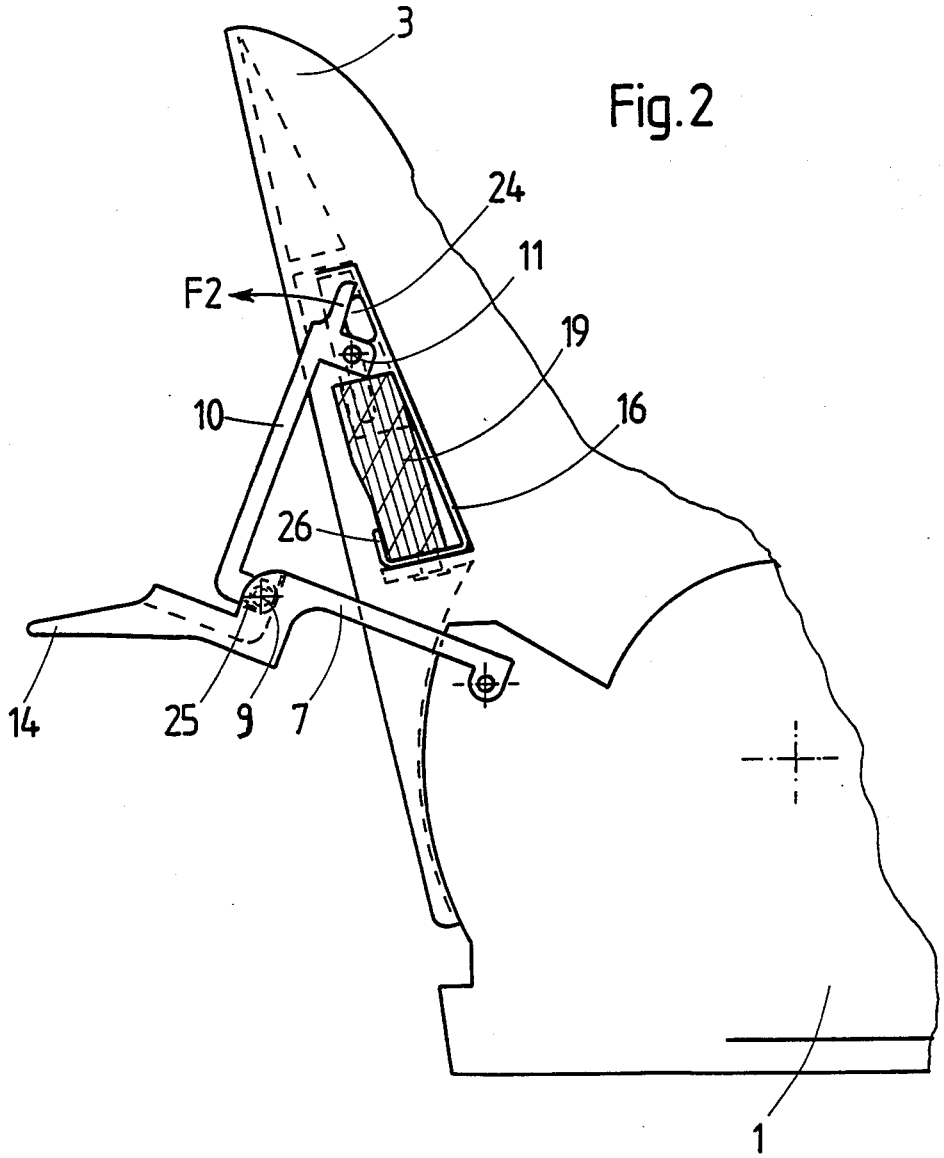
FIG. 2 shows the same mechanism in the open position, with the upper pivoted backwards.

The boot, which is partially and schematically shown, consists of a plastic shell 1, formed as a single piece with a sole 2 and surrounding the foot and the heel, and of an upper comprising a rear part 3 hinged with the shell 1 about an axis 4 coinciding at least approximately with the joint of the skier's foot. The upper may consist of one or two parts. In the case of a rear-fitting boot, the two parts of the upper are hinged about the pin 4. In both cases, the part 3 of the upper can be pivoted backwards a considerable distance, as shown in FIG. 2, on account of the special shape of the shell in the region 5 of the heel, as described in U.S. patent application Ser. No. 913,700, filed on Sept. 30, 1986 and still pending of the applicant. At the rear of the boot, the shell 1 and the part 3 of the upper are joined by a connecting mechanism 6 comprising a lever 7, the bottom end of which is hinged by means of a pin 8 with the shell 1 and a middle point of which is hinged by means of a pin 9 with a link 10, the other end of which is by means of a pin 11 with the upper 3. The lever 7 passes through a recess in the upper 3. The pin 8 hingeably connecting the lever 7 to the shell 1 is mounted in a gap 12, for example between two ribs or inside a clearance, the heel of the inner shoe (not shown) resting against 13, as described in Patent Application CH 174/86 of the Applicant. The lever has a protruding part 14 acting as a grip for the user so that the connecting mechanism 6 can be opened. A metal part 16 is fixed inside a recess 15 located in the upper 3 and in the form of a compartment, this metal part 16 consisting of a folded plate having, at the top, two parallel flanges 17 between which the pin 11 of the link is mounted. More precisely, this pin 11 is mounted in two opposite apertures 18 in the flanges 17, these apertures being oriented in the direction of the hinging points of the connecting mechanism 6 and the pin 11 being able to move inside them. As can be seen more clearly in FIG. 2, the link 10 is not rectilinear, but is bent at right angles at each of its ends so that internally it has a U-shaped profile which accommodates an elongated block 19 made of rubber or some other elastomer, which bears, at its bottom end, against a right-angled part 20 of the plate 16, itself fixed, by means of rivet, to a flange 21 of the upper 3. At its top end, the rubber element 19 bears against the top right-angled part of the link 10 carrying the hinging pin 11. The link 10 has, moreover, a portion 22 which extends beyond the pin- 11 and which is offset in relation to this pin. This extension 22, the top surface of the top right-angled part of the link 10 and the top part of the plate 16 with its flanges 17 define a recess 23 which accommodates a rubber ball 24. Moreover, a helical torsion spring is mounted around the pin 9 hingeably connecting the link 10 to the lever 7, this spring tending to oppose opening of the connecting mechanism 6.

Figure 1:
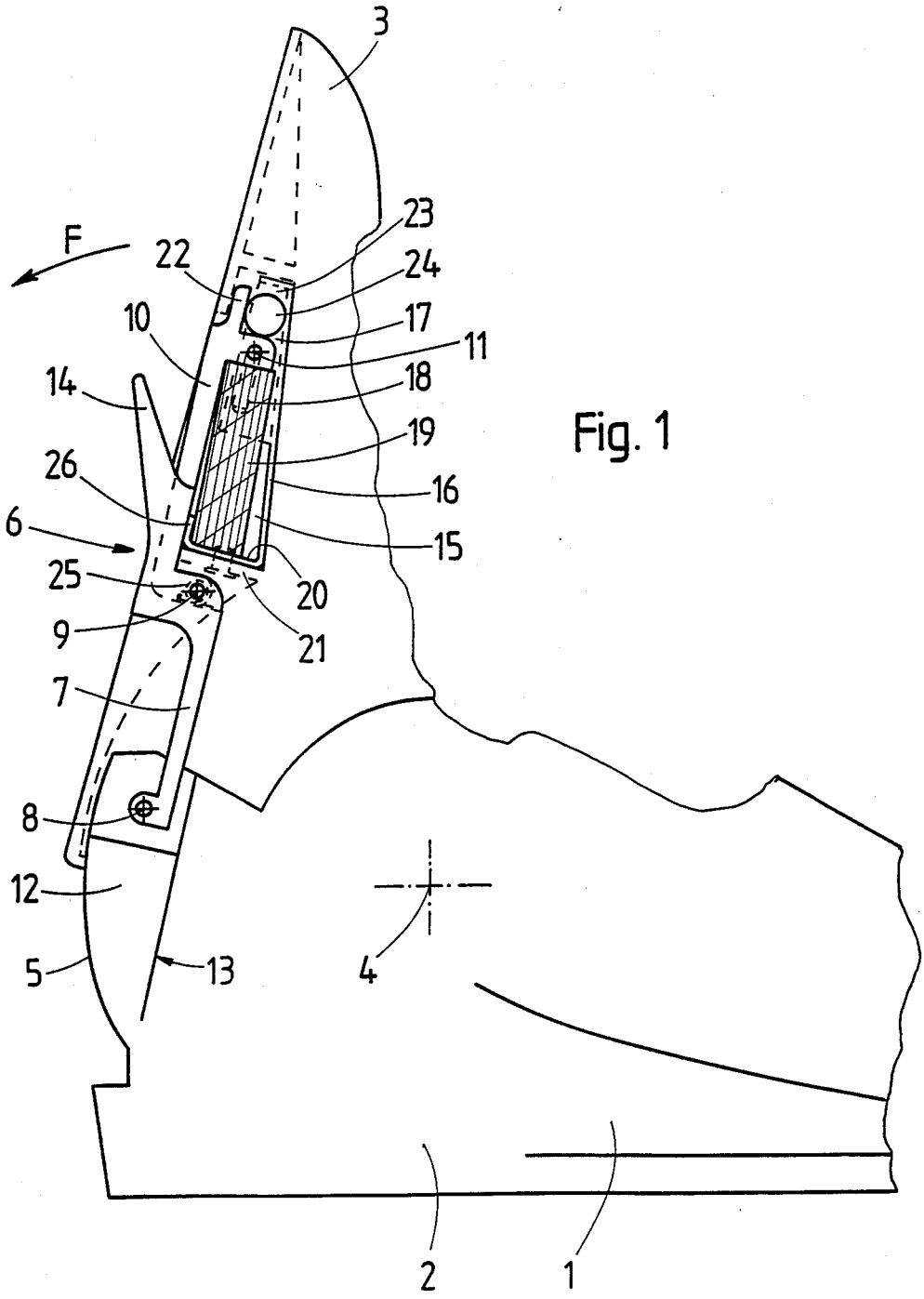
FIG. 1 is a partial schematic view of a ski boot equipped with the mechanism according to the invention in the closed position.

When the connecting mechanism is in the closed skiing position, as shown in FIG. 1, the link 10 rests against an external right-angled flange 26 of the plate 16, which flange also has the function of laterally retaining the elastic element 19, such that the hinging axes 8, 9 and 11 of the connecting mechanism are aligned. In this closed position, the upper 3 of the boot is kept in a position where it is inclined forwards slightly. Although the hinging axes of the connecting mechanism 6 are aligned, there is no risk of the mechanism being opened by a compressive force, since the rubber ball 24 and the spring 9 oppose this opening action. The connection between the upper and the shell, however, is not rigid, but allows a certain degree of elastic flexure owing to the presence of the elastic element 19. In fact, when the skier flexes his leg, causing the upper 3 to pivot, the pin 11 is able to move inside the apertures 18, thereby compressing the elastic element 19.

When the skier wishes to release the upper 3, he merely needs to pull very lightly the protruding part 14 of the lever 7 in the direction of the arrow F. As soon as the pin 9 hingeably connecting the link 10 to the lever 7 moves out of the straight line joining the two other hinging points 8 and 11, the skier is able to straighten his leg, thereby bringing into play the connecting mechanism 6.

In order to put on or take off a boot, the skier can pivot the upper or the part 3 of the upper backwards, as shown in FIG. 2. In this position, the rubber ball 24 is greatly compressed, i.e. deformed and the torsional spring 25 is torsioned. The frictional forces of the upper on the shell are, however, sufficient to oppose the torques exerted by the elastic elements of the connecting mechanism which tend to make the upper 3 pivot forwards.

Once the boot has been put on, the skier straightens the upper and does up the buckle(s) on the boot. He is then in the position corresponding to the rest position, in which the connecting mechanism 6 is slightly open. As soon as the skier assumes the skiing position, i.e. flexes his leg, a pulling force is exerted on the connecting mechanism 6 which tends to close. This closing action is completed and ensured by the torque exerted by the compressed elastic ball 24 on the extension 22 of the link 10, in the direction F2. It should be noted that the torsional spring 25, which is optional, as well as the elastic member 19 also help achieve this closing action. These same elastic elements ensure that the connecting mechanism is kept in the closed position.

Several variations of embodiment of the invention are possible. The main variation consists in providing the extension 22 at the bottom end of the lever 7 and arranging the rubber ball 24 between this extension and the shell. Similarly, the hinging pin 8 of the lever 7 could be mounted in apertures similar to the apertures 18 and the elastic element 19 could be mounted between the pin 8 and a stop integral with the shell, above the pin 8. According to a simplified arrangement, the elastic element 19 and the apertures 18 could be eliminated. The elastic element 19 could consist of any elastic member, such as a spring. The rubber ball 24 could be replaced by an elastic body with a different shape or even by a spring.

I claim:

1. Ski boot made of at least semi-rigid material and comprising a shell (1) comprising the sole, said shell surrounding the foot and the heel and said ski boot comprising an upper which is hinged with the shell about a transverse pin (4) and at least one part (3) of which can be pivoted backwards on the shell, and said ski boot comprising moreover, at its rear, a mechanism (6) connecting the shell and the upper, consisting of a lever (7) passing through the pivotable part of the upper and hinged, at its bottom end (8), with the shell and connected via a link (10) to the said part of the upper which can be pivoted, the lever (7) and the link (10) forming a knuckle joint, wherein the elastic body (24) is accommodated in a cavity formed between the upper and one of the ends of the connecting mechanism (6) hinged with the upper, this recess being limited on the outside by an extended portion (22) of the said end, which extended portion is oriented substantially parallel to the axis of the connecting mechanism (6) and extends beyond the point (11) where the latter is hinged with the boot, such that this elastic body is compressed when the connecting mechanism is opened.

2. Ski boot as claimed in claim 1, which also comprises a pin (9) hingeably connecting the link to the lever, and a spring (25) opposing opening of the connecting mechanism 6.

3. Ski boot as claimed in claim 1, wherein the upper has a stop (26) against which the connecting mechanism (6) abuts in the closed position, such that the axes of the three hinging points (8, 9, 11) of the connecting mechanism (6) are aligned.

4. Ski boot as claimed in claim 1 wherein said link (10) of the connecting mechanism (16) is hinged with the part which may pivot of the upper by means of a pin (11) mounted inside an aperture (18) formed in the upper and extending in the direction of a straight line joining the hinging points at the ends of the mechanism (6), and wherein said link (10) has, between this pin (11) and the middle of the connecting mechanism, a bearing surface which is applied, when the mechanism is closed, against one of an elastic member (19), said bearing surface having a bottom end which bears against a bearing surface (20, 21) integral with the part of the boot with which said link (10) is hinged.

* * * * *